US005810333A

United States Patent [19]

Hickerson et al.

[11] Patent Number: 5,810,333

[45] Date of Patent: Sep. 22, 1998

[54] RAM DEVICE

[75] Inventors: William R. Hickerson, Hamburg; Frank J. Tartaglia, Rockaway, both of N.J.

[73] Assignee: Curtiss Wright Flight Systems Inc., Fairfield, N.J.

[21] Appl. No.: 795,872

[22] Filed: Feb. 6, 1997

[51] Int. Cl.[6] ..... B66F 3/24

[52] U.S. Cl. ..... 254/93 R; 254/133 R; 254/134; 29/239

[58] Field of Search ..... 254/93 R, 89 H, 254/1, 126, 131, 133 R, 134, 249, 93 H; 29/239; 248/354.1

[56] References Cited

U.S. PATENT DOCUMENTS

| | | | |
|---|---|---|---|
| 2,135,278 | 11/1938 | Countryman . | |
| 2,483,239 | 9/1949 | Sharpe | 254/93 R |
| 2,795,934 | 6/1957 | Jenkins | 254/93 R |
| 2,795,935 | 6/1957 | Fitzgerald | 254/93 R |
| 2,874,933 | 2/1959 | Feucht | 254/93 R |
| 3,518,864 | 7/1970 | Pietronuto et al. | 254/93 R |
| 3,891,187 | 6/1975 | Bearden, Jr. . | |
| 4,270,733 | 6/1981 | DePue | 254/93 R |
| 4,279,141 | 7/1981 | Gallart . | |
| 4,732,029 | 3/1988 | Bertino . | |
| 4,783,053 | 11/1988 | Yirmiyahu et al. . | |
| 5,297,780 | 3/1994 | Hickerson . | |
| 5,544,862 | 8/1996 | Hickerson . | |

*Primary Examiner*—James G. Smith
*Assistant Examiner*—Lee Wilson
*Attorney, Agent, or Firm*—Klauber & Jackson

[57] ABSTRACT

A spreading tool which includes a hollow tube, a first ram member, and a second ram member. The hollow tube has a tubular wall with an axial throughbore and at least one opening extending through the tubular wall. The ram members are slidingly disposed within the throughbore, and at least one ram member is capable of extending beyond the outer edge of the hollow tube. The tool can be adapted for use with a force multiplying device which transmits an output force through a relative displacement between at least two spreadable tips. The first and second ram members are capable of being spaced apart by the force multiplying device such that the tool is capable of extending the expandable distance of the jaws and increasing the distance over which the output force is transmitted.

68 Claims, 13 Drawing Sheets

RAM DEVICE

BACKGROUND OF THE INVENTION

1. Field of the Invention

This invention relates to a ram device or ram type spreading tool or a tool used with a force multiplying device which transmits an output force through a relative displacement between at least two spreadable tips, and particularly portable rescue devices having at least two expandable jaws.

2. Description of the Prior Art

Powered portable rescue tools, such as the "POWER HAWK®" which is manufactured and sold by Curtiss Wright Flight Systems, Inc., of Fairfield, N.J., and the "JAWS OF LIFE®" which is manufactured and sold by Hurst Performance, Inc., of Warminster, Pa., are specialized tools used by rescue personnel to extricate accident victims from vehicles, buildings, and other structures which otherwise impose a difficult or nearly impossible means of egress. These tools typically develop spreading or closing forces for opening or ripping apart inoperable doors, damaged structures, or blocked pathways. Pushing or pulling forces of 7,000 to 15,000 pounds are typically produced at the working tips of a pair of jaws of such expandable jaw power tools. These high forces are achieved by various power supply means, including pneumatic, hydraulic, gasoline and electric power units. Police, fire, and paramedic personnel must apply these devices in a variety of emergency situations.

However, the distance or range over which the spreading or cutting force can be applied is limited to the maximum spreadable distance between the two spreading tips of the rescue tool. In situations where a larger opening is required, or where a suitable brace or prop or support is available but located beyond the expandable reach of the rescue tool, the tool could be rendered virtually ineffective. Parts of an automobile such as the door or steering wheel, may be so badly damaged and contorted that the expandable range of the rescue tool is insufficient to extricate a victim.

Among the objects of the present invention is to provide a tool for use with a force multiplying device which transmits an output force through a relative displacement between at least two spreadable tips and thereby extends the depth of the jaws and makes greater use of the power stroke of the jaws or arms of such devices.

It is another object to provide a tool for use with portable rescue devices having at least two expandable jaws.

It is still another object to provide a tool which enables the full spreading power of such devices to be exerted over a greater distance.

It is another object to provide a tool of durable, heavy duty construction capable of withstanding the forces generated by such devices.

It is yet another object to provide a tool requiring little or no additional power requirements.

It is a further object to provide a tool which is portable.

It is a still further object to provide a tool which requires little maintenance.

It is another object to provide a tool which is lightweight and easy to use.

SUMMARY OF THE INVENTION

The present invention comprises a tool for use with a force multiplying device which transmits an output force through a relative displacement between at least two spreadable tips. The tool comprises a hollow tube, a first extension member disposed in the tube, a second extension member disposed in the tube, wherein the first and second extension members are capable of being moved apart, and means for receiving the spreadable tips in the tube and for allowing the spreadable tips to contact the first and second extension members. An increase in the relative displacement between the spreadable tips induces an increase in a relative displacement between the first and second extension members, such that the output force is transmitted from the spreadable tips through the extension members, and the tool is capable of increasing the distance over which the output force is transmitted. The first and second extension members are preferably slidingly disposed in the tube, although one of the members may be fixed at a particular location within the tube.

The tool may further include means for preventing the rotation of the first extension member, means for preventing the rotation of the second extension member, and/or means for selectively fixing the second extension member within the tube. A handle means is disposed on an outer surface of the tube.

The first extension member may further comprise a telescoping extension member.

The tool may also include means for limiting the insertion of the first extension member into the tube, means for distributing the force transmitted through the first extension member, bracket means attached to the distal end of the first extension member, and/or means for distributing the force transmitted through the second extension member.

A base plate may be attached to a distal end of the second extension member. In a particular embodiment, a base ring may be removably attached to a distal end of the second extension member. The second extension member may further comprise a pointed distal end.

A gripping means may be disposed on a distal end of the first or second extension members for reducing slippage of the tool during use.

In another embodiment, the present invention comprises a spreading tool including a hollow tube, a first ram member, and a second ram member. The hollow tube has a tubular wall with inner and outer surfaces, first and second ends, an axial throughbore defined by the inner surface of the tubular wall and extending from the first end to the second end along a longitudinal axis, and at least one opening extending through the tubular wall.

The first ram member is slidingly disposed within the throughbore and has an outwardly facing end and an inwardly facing end, wherein the outwardly facing end is capable of extending beyond the first end of the hollow tube. The second ram member is slidingly disposed within the throughbore and has an outwardly facing end and an inwardly facing end, wherein the outwardly facing end is capable of extending beyond the second end of the hollow tube.

The inwardly facing ends of the first and second ram members are capable of being spaced apart between a minimum offset and a second offset in an activation portion of the hollow tube, wherein at least a portion of the opening is disposed over the activation portion of the hollow tube, and wherein one or both of the ram members are capable of projecting at least partially out of the hollow tube when the ram members are separated by the second offset.

The first ram member may further comprise a shell member slidingly disposed within the throughbore and having an inwardly facing closed end and an outwardly facing open end, an outwardly facing axial bore extending partially into the shell member, and a support rod inserted into the axial bore. The support rod is slidingly disposed in the axial bore. A means for selectively limiting the insertion of the support rod into the hollow tube may be provided, wherein one or more longitudinally spaced transverse holes are disposed in the support rod and at least one pin is included for insertion into one of the holes. In a particular embodiment, the pin is capable of abutting the first end of the hollow tube.

The second ram member may further comprise means for selectively fixing the second ram member within the throughbore, which includes one or more transverse holes disposed in the second ram member, one or more transverse holes disposed through the hollow tube, and at least one adjustment pin for insertion into one of the holes in the tube and one of the holes in the second ram member. In a particular embodiment, the spreading tool may include means for selectively fixing the second ram member in more than one fixed position, with a series of longitudinally spaced holes.

A base plate may be provided which is adapted to engage the outwardly facing end of the second ram member. The base plate may be removably attached to the second ram member.

The outwardly facing end of the second ram member may comprise a substantially conical tip portion, and the base plate would then comprise a base ring having an internal bore adapted to slide onto and engage the conical tip portion.

The base ring may further comprise a gripping means disposed on an outwardly facing surface of the base ring. The gripping means may further comprise at least one projection extending from the outwardly facing surface of the base plate.

Alternately the outwardly facing end of the second ram member may comprise a substantially flat portion. The base plate can be threadedly attached to the second ram member.

A handle means is disposed on the outer surface of the tubular wall.

The spreading tool may further comprise a means for preventing rotation of the first and second ram members, which includes a slot means disposed on the inner surface of the tubular wall, a first engagement means disposed on the outer surface of the first ram member and adapted to slidingly engage the slot means for allowing the ram member to slide axially within the throughbore of the hollow tube and for substantially preventing rotation of the ram member, and a second engagement means disposed on the outer surface of the second ram member and adapted to slidingly engage the slot means for allowing the ram member to slide axially within the throughbore of the hollow tube and for substantially preventing rotation of the ram member.

The support rod may further comprise a telescoping support rod.

The inwardly facing end of the first ram member further comprises an interior end plate wherein the end plate includes a projection portion adapted to extend at least partially through the opening and to abut a portion of the tubular wall surrounding the opening, whereby any contact between the projection portion and the hollow tube substantially prevents the first ram from rotating.

The spreading tool may include a means for limiting the entry of the shell member into the throughbore of the hollow tube, wherein a collar member is attached to the outwardly facing open end of the shell member and has a central bore adapted to allow the support rod to slide therethrough, wherein at least a portion of the collar is capable of abutting the first end of the hollow tube. The collar member may be threadedly attached to the shell member, or attached to the shell member by threaded fasteners, or fixedly attached to the shell member. If the first ram member is provided with a pin, the pin may be capable of abutting the collar member.

The spreading tool may further include a bracket member attached to the outwardly facing end of the first ram member. The bracket member comprises a base portion and two opposite arm portions. In one aspect, the arm portions are disposed at substantially right angles from the base portion, and in another aspect the arm portions are disposed at obtuse angles from the base portion.

In yet another embodiment, the present invention relates to a spreading tool for use with a portable rescue device having at least two expandable jaws. The tool comprises a first elongate piston member, a second elongate piston member, and a hollow tube adapted to hold the first and second piston members in spaced apart end-to-end relationship. The tube includes means for allowing the expandable jaws to move apart the first and second piston members, and the tool is capable of extending the expandable distance of the jaws.

The first and second piston members are slidingly disposed in the tube, although one of the piston members, preferably the second piston member, may be at least temporarily fixed within the tube. The tool may include means for preventing the rotation of the first piston member and/or means for preventing the rotation of the second piston member.

The tool may also include means for selectively fixing the second piston member within the tube.

A handle means is disposed on an outer surface of the tube.

The first piston member may further comprise a telescoping piston member.

The tool may further include means for limiting the insertion of the first piston member into the tube, a force distribution means attached to a distal end of the first piston member, bracket means attached to a distal end of the first piston member, and/or a force distribution means attached to a distal end of the second piston member.

A base plate may be attached to a distal end of the second piston member, or a base ring may be removably attached to a distal end of the second piston member. The second piston member may have a pointed distal end which is compatible with the base ring.

A gripping means may be disposed on a distal end of the first or second piston member for reducing slippage of the tool during use.

Thus the present invention provides a tool for use with a force multiplying device which transmits an output force through a relative displacement between at least two spreadable tips and thereby extends the depth of the jaws and makes greater use of the power stroke of the jaws or arms of such devices. The tool can be used with portable rescue devices having at least two expandable jaws, and enables the full spreading power of such devices to be exerted over a greater distance. The tool can be constructed to be durable and heavy duty so as to be capable of withstanding the forces generated by such devices. The tool requires little or no additional power requirements or maintenance. The tool is generally portable and easy to use. The tool may also be constructed to be of relatively light weight.

DESCRIPTION OF THE PREFERRED EMBODIMENT

Figure 1:
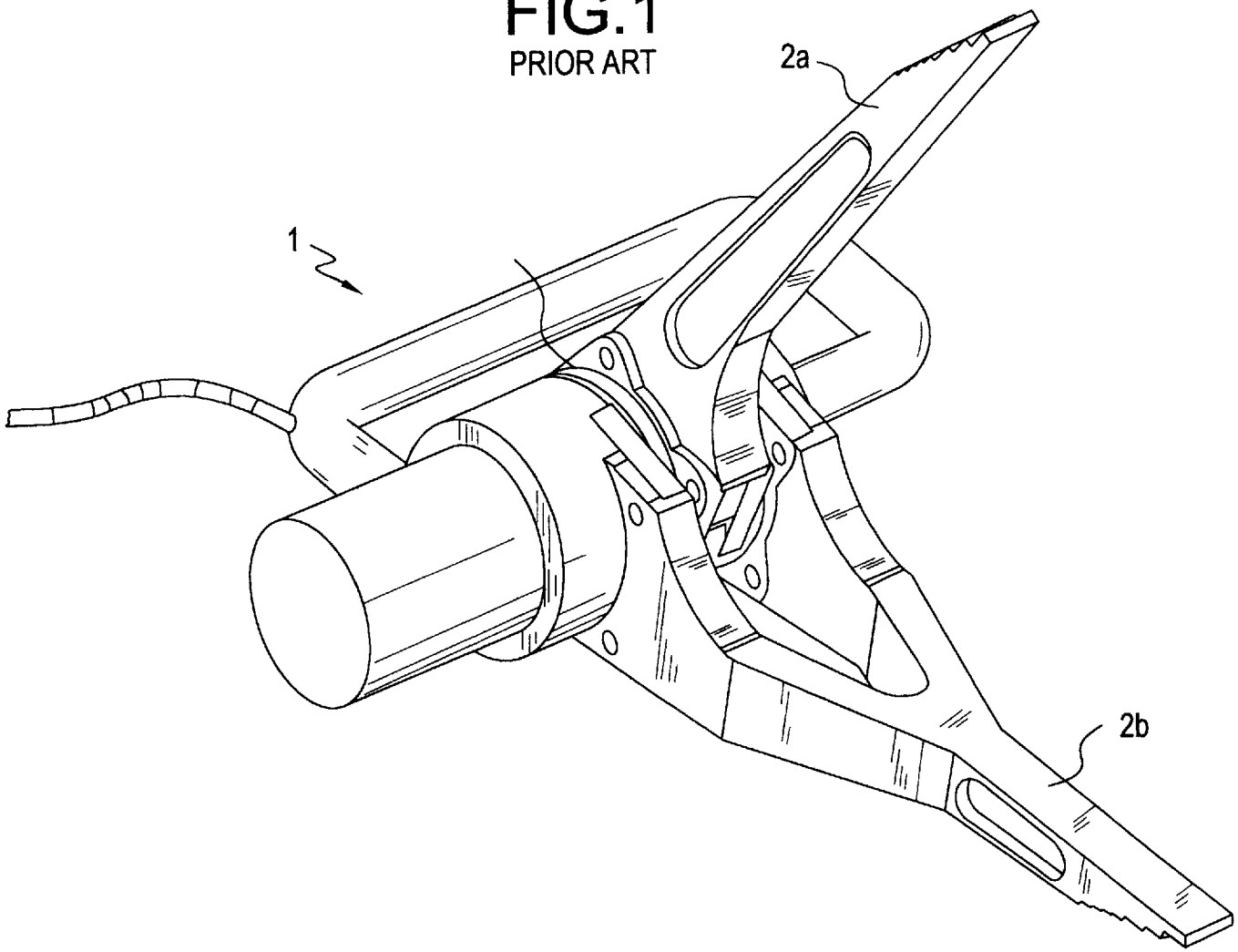
FIG.1 PRIOR ART
FIG. 1 is an isometric view of a prior art force multiplying device which may be used with the present invention.

The present invention comprises a tool for use with a force multiplying device which transmits an output force through a relative displacement between at least two spreadable tips. The tool comprises a hollow tube, a first extension member disposed in the tube, a second extension member disposed in the tube, such that the first and second extension members are capable of being moved apart, and a means for receiving the spreadable tips in the tube and for allowing the spreadable tips to contact the first and second extension members. An increase in the relative displacement between the spreadable tips induces an increase in a relative displacement between the first and second extension members whereby the output force is transmitted from the spreadable tips through the extension members. Thus, the tool is capable of increasing the distance over which the output force is transmitted.

The present invention also comprises a spreading tool for use with a portable rescue device having at least two expandable jaws. The tool comprises a first elongate piston member, a second elongate piston member, and a hollow tube adapted to hold the first and second piston members in spaced apart end-to-end relationship, the tube including means for allowing the expandable jaws to move apart the first and second piston members. The tool is thus capable of extending the expandable distance of the jaws.

The present invention further comprises a spreading tool which includes a hollow tube, a first ram member, and a second ram member. The hollow tube has a tubular wall with inner and outer surfaces, first and second ends, an axial throughbore defined by the inner surface of the tubular wall and extending from the first end to the second end along a longitudinal axis, and at least one opening extending through the tubular wall. The first ram member is slidingly disposed within the throughbore and has an outwardly facing end and an inwardly facing end, wherein the outwardly facing end is capable of extending beyond the first end of the hollow tube. The second ram member is slidingly disposed within the throughbore and has an outwardly facing end and an inwardly facing end, wherein the outwardly facing end is capable of extending beyond the second end of the hollow tube. The inwardly facing ends of the first and second ram members are capable of being spaced apart between a minimum offset and a second offset in an activation portion of the hollow tube. At least a portion of the opening is disposed over the activation portion of the hollow tube, and one or both of the ram members are capable of projecting at least partially out of the hollow tube when the ram members are separated by the second offset.

Thus, the present invention may be used as a means for extending the expanding distance of known rescue tools or power tools or force multiplying devices for applying high magnitude push/pull forces. The known rescue tools may comprise pivotal arms and activating means to apply forces to the arms for movement and relative displacement of the arms. In one embodiment, an outer cylinder is provided with a longitudinally extending slot for receiving spreading tips from a rescue tool or the like which in turn drive ram elements telescoped within the outer cylinder so as to extend the expanding of the rescue tool, etc. One ram element may be fixed within the cylinder, while the other ram element serves as a moveable ram member which extends out of the cylinder.

The present invention may be used for separating, pushing, pulling, or dividing various objects. The forces available at the tips of the spreadable arms or jaws of the power device are available for opening, ripping, breaking, spreading, detaching, or moving internal or external structures. The invention may also be used for bending, splitting, lifting, separating, flattening, or straightening various structures.

The present invention may be applied to motor vehicles such as automobiles, trucks, boats, airplanes, military craft, or the like, or portions thereof. The invention may further be applied to buildings, plant machinery, and other fixtures or structures or the like, or portions thereof.

The present invention may also be used with a jack device or the like. The jack may be operably inserted into the present invention and expanded by cranking, pumping, screwing, or other means of actuation.

The present invention may thus be used to deliver precise control of the extension of the known device.

FIG. 1 shows one example of a prior art force multiplying device or portable rescue device 1 which may be used with the present invention. FIG. 1 corresponds to FIG. 1 of U.S. Pat. No. 5,297,780 and shows spreadable tips 2*a*, 2*b* which may be inserted into the present invention as described below. The operation of device 1 is described in U.S. Pat. No. 5,297,780. It should be understood that the present invention may also be used with other types of devices having spreadable tips.

Figure 2:
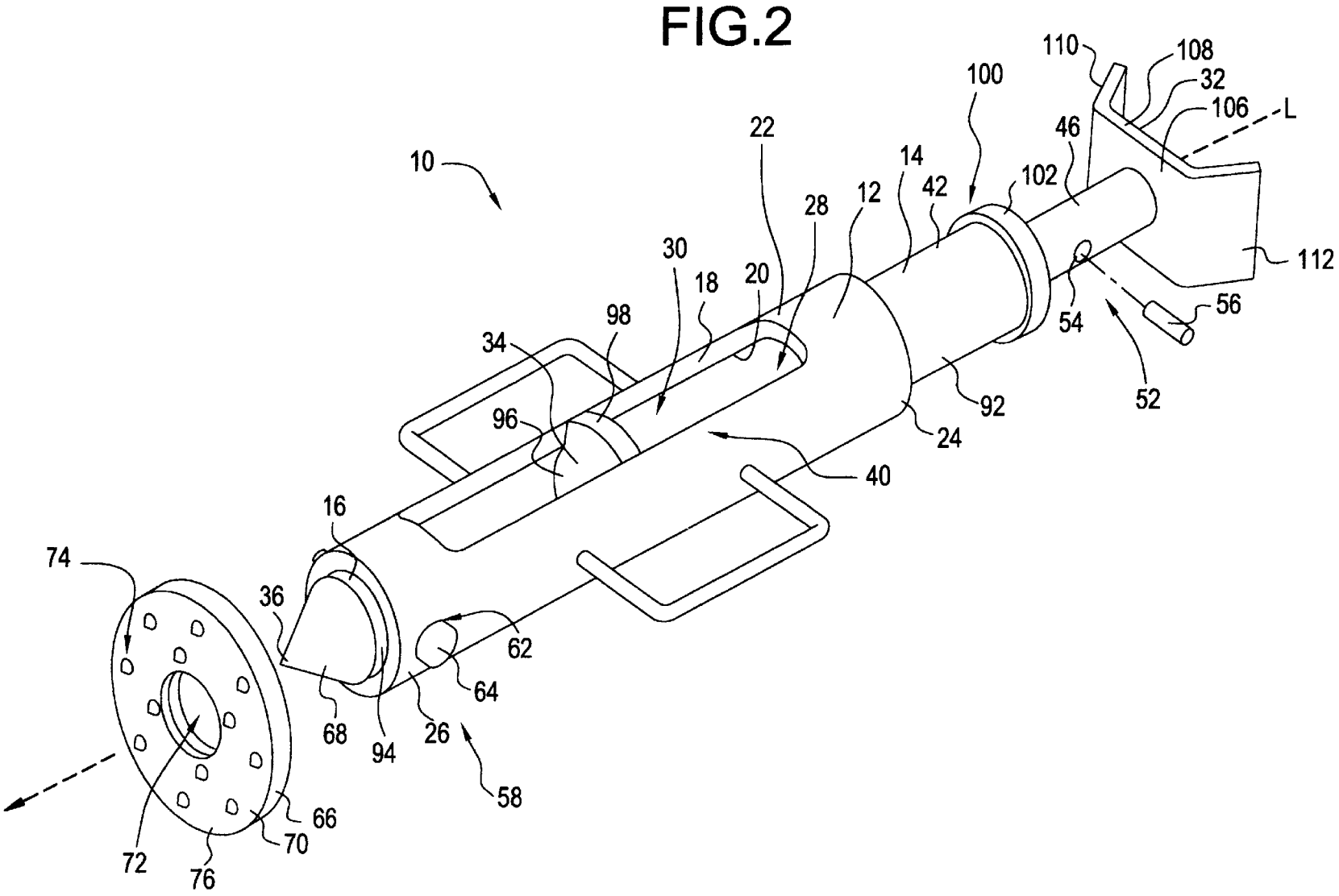
FIG. 2 is a perspective view of a first embodiment of the present invention showing a telescoping first ram member, a bracket member with oblique arms, a second ram member with a conical tip portion, and a base ring.
Figure 3:
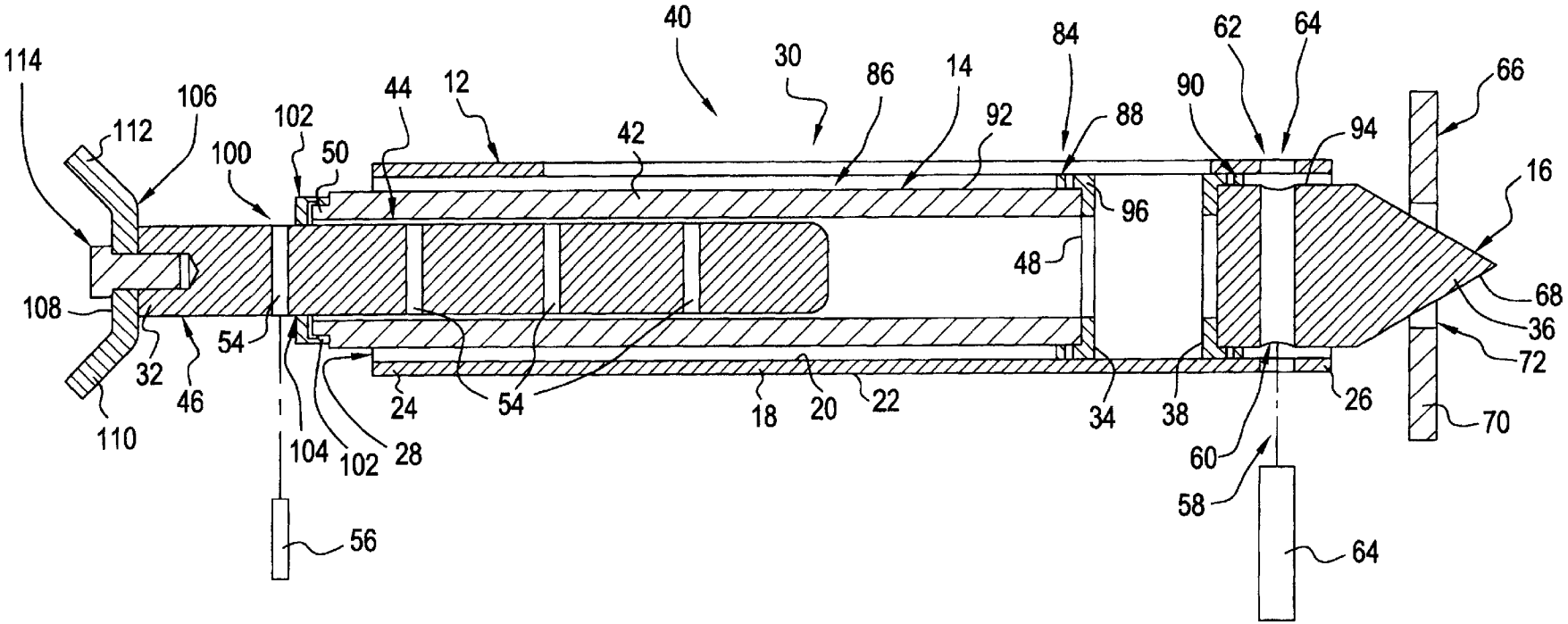
FIG. 3 is an elevational cutaway view of a second embodiment similar to that of FIG. 1 but having an alternate means of limiting the insertion of the support rod into the shell member, and shown without a gripping means at a distal end.

With specific reference to the drawings, the embodiments shown in FIGS. 2–3 depict a spreading tool 10 comprising a hollow tube 12, a first extension member or ram member 14, and a second extension member or ram member 16.

The hollow tube 12 has a tubular wall 18 with inner and outer surfaces, 20, 22, first and second ends, 24, 26, an axial throughbore 28 defined by the inner surface 20 of the tubular wall 18 and extending from the first end 24 to the second end 26 along a longitudinal axis L—L, and an opening 30 extending through the tubular wall 18. The opening 30 shown in FIG. 2 has a generally rectangular outline with rounded corners. However, the opening 30 may assume various shapes and dimensions to be compatible with a particular device or variety of devices which may be inserted into the opening 30, which devices are used to force one or both ram members 14, 16 out of the tube 12. For example, the opening 30 may be round, oval, square, elliptical, etc. Furthermore, more than one opening 30 may be provided in the tube, for example, diametrically opposed openings on either side of the tube 12, or openings disposed on the same side of the tube 12 but on opposite ends, or openings on opposite sides and longitudinally offset openings. By way of example, the spreadable tips 2*a*, 2*b* of the device 1 shown in FIG. 1 may be inserted into the opening 30 and exert force on the ram members 14, 16.

The first ram member 14 is slidingly disposed within the throughbore 28 and has an outwardly facing end 32 and an inwardly facing end 34. The outwardly facing end 32 is capable of extending beyond the first end 24 of the hollow tube 12, as illustrated in the embodiment shown in FIG. 4. The outwardly facing end 32 may also be adapted to lie within the confines of the hollow tube or cylinder 12, particularly in a resting or nonoperative state, as illustrated in the embodiment shown in FIG. 5.

The second ram member 16 is also slidingly disposed within the throughbore 28 and has an outwardly facing end 36 and an inwardly facing end 38. The outwardly facing end 36 is capable of extending beyond the second end 26 of the hollow tube 12, as illustrated in the embodiment shown in FIG. 4. The outwardly facing end 36 may also be adapted to lie within the confines of the hollow tube or cylinder 12, particularly in a resting or nonoperative state, as seen in FIG. 3. The spreadable tips of a prior art force multiplying device or portable rescue device are shown in phantom in FIG. 4 as being inserted into the opening 30 and contacting first and second ram members 14, 16.

The inwardly facing ends 34, 38 of the first and second ram members 14, 16 may have flat, concave, or convex surfaces. The ends 34, 38 may further be provided with protrusions, slots, grooves, indentations or other means to accommodate the tips of a force multiplying device and to maintain contact between the tips and the ram members 14, 16 in order to promote the transfer of force from the force multiplying device to the ram members.

The hollow tube 12 holds the first and second ram members 14, 16 in spaced apart end-to-end relationship. The tube 12 and ram members 14, 16 may be constructed such that the inwardly facing ends 34, 38 contact, or nearly contact, each other, particularly in a resting or nonoperative state, as in FIG. 5. The inwardly facing ends 34, 38 of the first and second ram members 14, 16 are capable of being spaced apart between a minimum offset and a second offset in an activation portion 40 of the hollow tube 12. At least a portion of the opening 30 is disposed over the activation portion 40 of the hollow tube 12. The activation portion 40 corresponds to the section of the tool 10 in which actuation of the first and second ram members 14, 16 is effected by the force multiplying device. Preferably, the opening 30 is large enough to accommodate the fully expanded tips of the force multiplying device.

The minimum offset preferably corresponds to the minimum separation distance required to operatively insert the tips of a desired force multiplying device between the first and second ram members 14, 16. An increase in the relative displacement between the tips results in the ram members 14, 16 being separated to a second offset, or plurality of second offsets, which are greater than the minimum offset. One or both of the ram members 14, 16 are capable of projecting at least partially out of the hollow tube 12 when the ram members are separated by the second offset. Thus, the force which is transmitted through the displacement of the tips of the force multiplying device is further transmitted through the tool 10. The tool may be adapted so that the first and second ram members 14, 16 may be separated by a maximum working offset corresponding to the widest gap attainable by the tips of the multiplying device while inserted in opening 30.

The first ram member 14 further comprises a shell member 42, an outwardly facing axial bore 44, and a support rod 46. The shell member 42 is slidingly disposed within the throughbore 28 and has an inwardly facing closed end 48 and an outwardly facing open end 50. The outwardly facing axial bore 44 preferably extends partially into the shell member 42, and the support rod 46 is inserted into the axial bore 44. The support rod 46 is preferably slidingly disposed in the axial bore 44. Thus, the support rod 46 illustrated in FIGS. 2 and 3 is a telescoping support rod.

Figure 6:
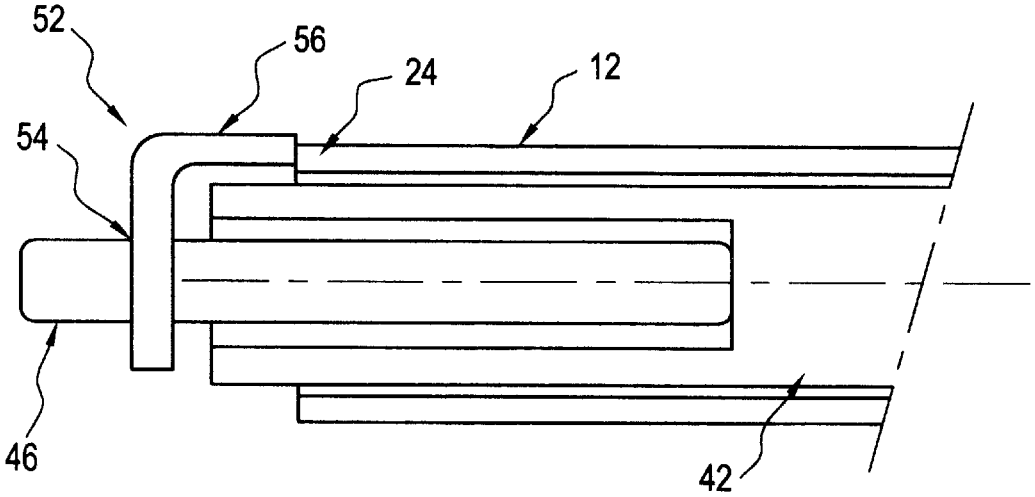
FIG. 6 is a partial side elevational cutaway view of an embodiment of a first ram member having a pin which abuts the hollow tube and limits the insertion of the support rod into the tube.

FIG. 6 illustrates a particular embodiment having a means 52 for selectively limiting the insertion of the support rod 46 into the hollow tube 12. One or more longitudinally spaced transverse holes 54 are disposed in the support rod 46 and at least one pin 56 for insertion into one of the holes. The pin 56 may be adapted to abut the first end 24 of the hollow tube 12. Preferably the hole 54 extends through the support rod 46. The pin 56 may also abut shell member 42, thereby also limiting the insertion of the support rod 46 into the shell member 42.

Figure 7:
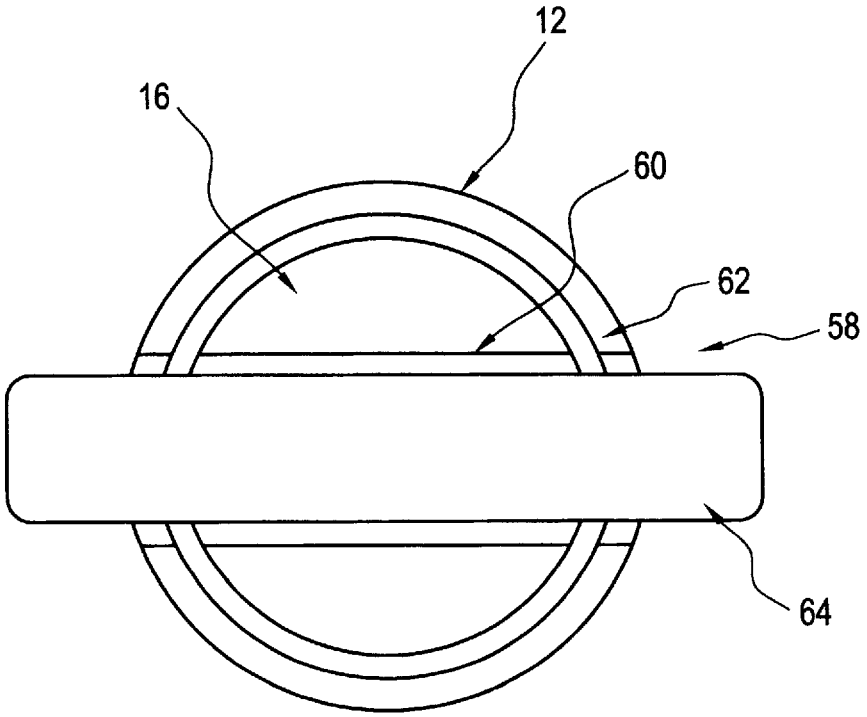
FIG. 7 is a cross-sectional view of an embodiment of a second ram member fixedly disposed within the tube by an adjustment pin.

As seen in FIG. 7, the second ram member 16 also includes means 58 for selectively fixing the second ram member 16 within the throughbore 28, the means 58 including one or more transverse holes 60 disposed in the second ram member 16, one or more transverse holes 62 disposed through the hollow tube 12, and at least one adjustment pin 64 for insertion into one of the holes 62 in the tube 12 and one of the holes 60 in the second ram member 16.

Two or more longitudinally spaced transverse holes 54 may be disposed in the support rod 46, wherein one pin 56 is inserted into one of the holes 54.

FIG. 2 illustrates an embodiment having at least one transverse hole 60 disposed in the second ram member 16, one transverse hole 62 disposed through the hollow tube 12, and one adjustment pin 64 for insertion into hole 62 in the tube 12 and hole 60 in the second ram member 16.

Figure 8:
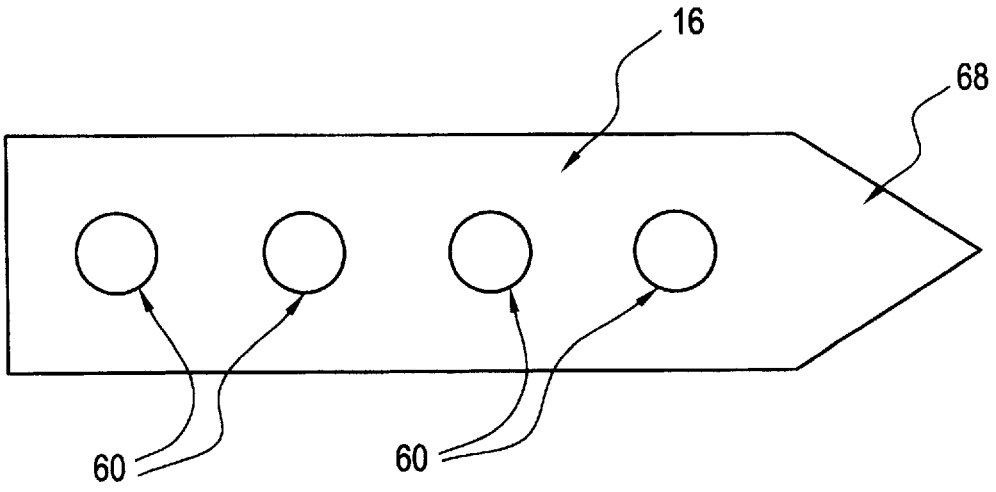
FIG. 8 is a side view of an embodiment of a second ram member having a plurality of holes for allowing the second ram member to be selectively fixed in more than one position within the tube.

As seen in FIG. 8, the second ram member 16 may also be selectively fixed in more than one fixed position with a series of longitudinally spaced holes 60 in the second ram member 16.

Figure 9:
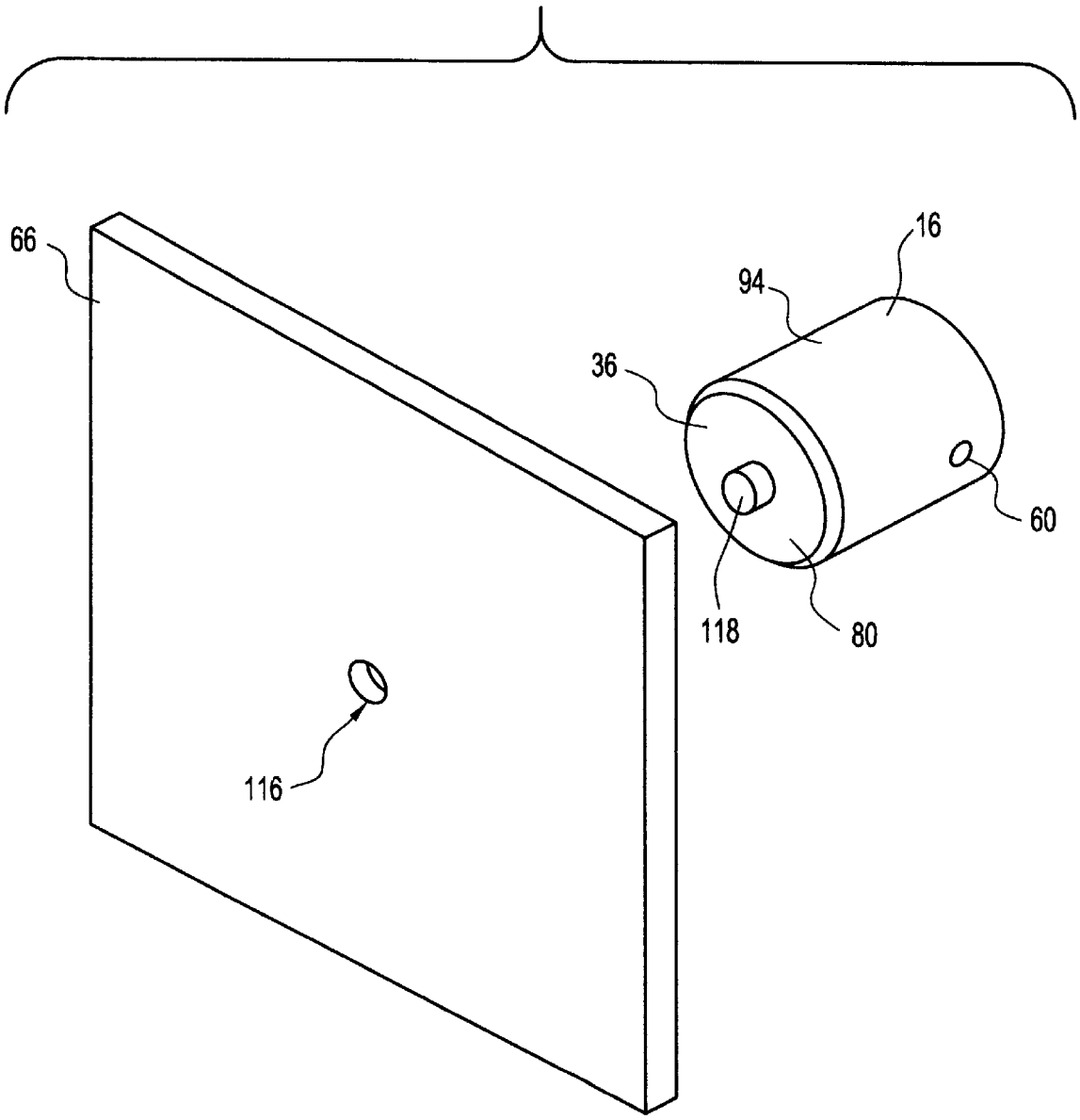
FIG. 9 is a perspective view of an embodiment of the distal end of a second ram member and a base plate.

As shown in FIGS. 2, 3 and 9, the spreading tool 10 may further include a base plate 66 adapted to engage the outwardly facing end 36 of the second ram member 16. The base plate 66 can be fixedly or removably attached to the second ram member 16. The base plate 66 may distribute the force transmitted through the tool 10, here through second ram member 16, over a greater area at the outwardly facing end 36. Additionally, the base plate 66 extends the lateral or transverse reach of the tool 10 in order to gain a footing or grip on an object.

The outwardly facing end 36 of the second ram member 16 is shown in FIGS. 2, 3 and 8 with a pointed or substantially conical tip portion 68. The conical tip portion 68 can serve as an anchoring means or as a piercing means as required by an application of the tool 10. The conical tip portion 68 may engage an object without the use of any base plate 66 if warranted in a particular application.

The base plate 66 of FIGS. 2 and 3 is in the form of a base ring 70 having an internal bore 72 adapted to slide onto and engage the conical tip portion 68. The base ring 70 further comprises a gripping means 74 (not shown in FIG. 3) disposed on an outwardly facing surface 76 of the base ring 70. The gripping means 74 has at least one projection 78 extending from the outwardly facing surface 76 of the base plate 66 or base ring 70. The distal end of the conical tip portion 68 preferably extends beyond the outwardly facing surface 76, but may terminate before reaching surface 76. The gripping means 74 engages a surface of an object against which the tool 10 is positioned and assists in the prevention of slippage between the tool 10 and the object.

The outwardly facing end 36 of the second ram member 16 shown in FIG. 9 has a substantially flat portion 80. The base plate 66 can be fixedly or threadedly attached to the second ram member 16.

As seen in FIG. 2 a handle means 82 may be disposed on the outer surface 22 of the tubular wall 18. Two handles are shown in FIG. 2 disposed on opposite sides of the outer surface 22 of the tubular cylinder 12. The handle means 82 may be grasped in order to position the tool 10 for operation.

Figure 10:
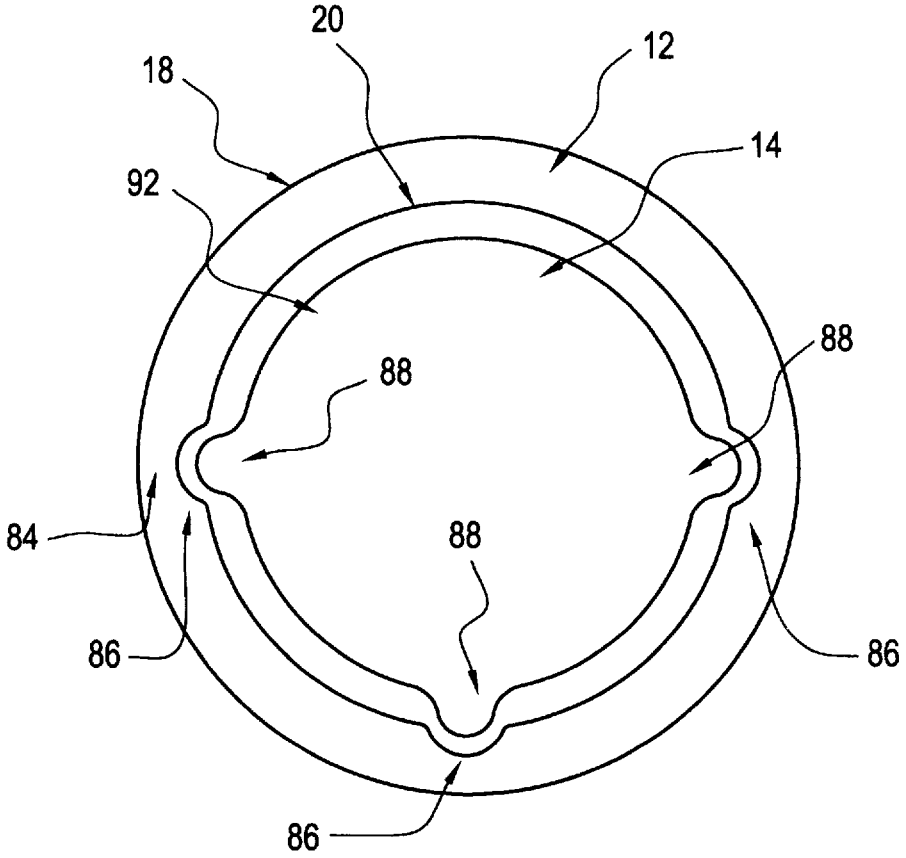
FIG. 10 is a cross-sectional view of an embodiment of a first ram member having an engagement means which includes a plurality of protrusions and a tube having a corresponding slot means.

The spreading tool 10 further preferably comprises a means 84 for preventing rotation of the first and second ram members, 14, 16, shown in the particular embodiments of FIGS. 3 and 10 as a slot means 86, a first engagement means 88, and a second engagement means 90. The tool 10 preferably includes means 84 for preventing rotation of the first and second ram members, 14, 16, because it is typically desirable to convert all of the available force generated by the force multiplying device into translational motion while minimizing rotational motion. Rotational motion may produce distortion of the object(s) against which the tool 10 is propped or positioned, which may result in the destruction of an anchoring point which is necessary to displace another portion of the object or another object. Furthermore. rotational motion may detract from the stability of the positioning of the tool 10 during use such that the tool 10 may tend to roll or slide off a contact point of interest.

The slot means 86 is disposed on the inner surface 20 of the tubular wall 18. The slot means 86 may comprise one or more longitudinally aligned grooves or slots which preferably extend along the entire length of the inner surface 20 of the tube 12.

The first engagement means 88 is disposed on the outer surface 92 of the first ram member 14, or the outer surface of shell member 42, and is adapted to fit into and slidingly engage the slot means 86. The first engagement means 88 allows the ram member 14 to slide axially within the throughbore 28 of the hollow tube 12 and substantially prevents rotation of the first ram member 14 within the tube 12.

In a similar fashion, the second engagement means 90 is disposed on the outer surface 94 of the second ram member 16, and is adapted to slidingly engage the slot means 86. The second engagement means 90 allows the ram member to slide axially within the throughbore 28 of the hollow tube 12 and substantially prevents rotation of the second ram member 16.

The first and second engagement means 88, 90 may comprise one or more projections, or protrusions, or ridges, or nubs, which fit into and slide within the slot means 86.

Figure 11:
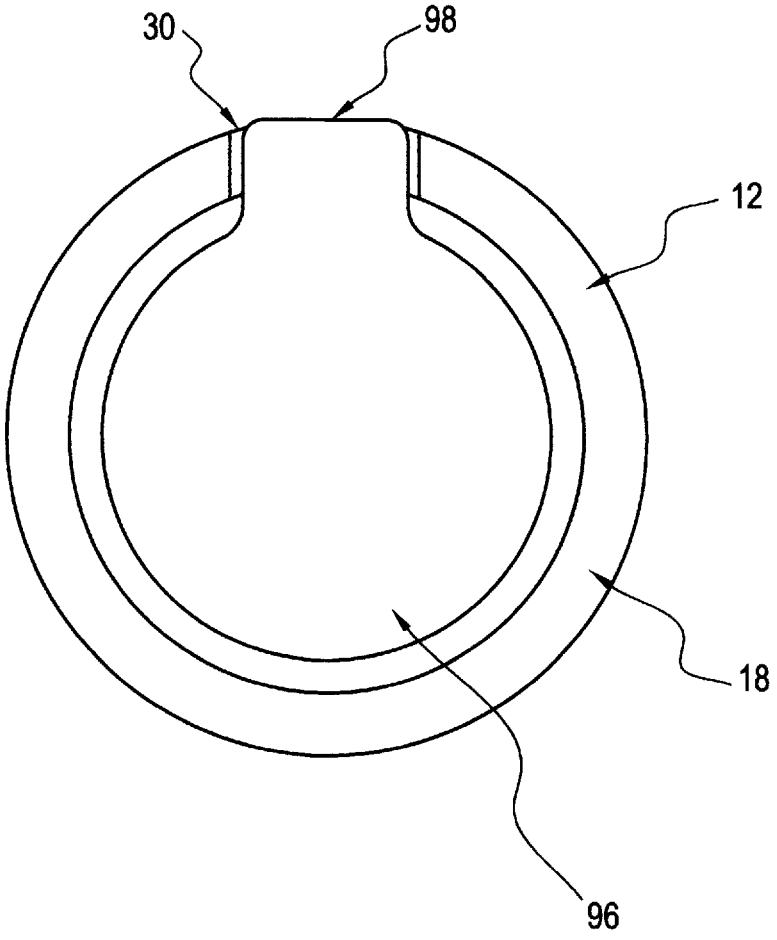
FIG. 11 is a cross-sectional view of an embodiment of a first ram member having a protrusion portion extending through the opening in the tube.

At the inwardly facing end 34 of the first ram member 14 in FIGS. 2, 3 and 11 is an interior end plate 96, and as best seen in FIGS. 2 and 11, includes a projection portion 98 which extends at least partially through the opening 30 and abuts a portion of the tubular wall 18 surrounding the opening 30. Any contact between the projection portion 98 and the hollow tube 12 substantially prevents the first ram 14 from rotating. Thus, the projection portion 98 and the opening 30 may serve as a means for preventing rotation of the first ram member 14. The projection portion 98 may also serve as an additional contact area or means of accommodating one or more tips of a force multiplying device. Moreover, the projection portion 98 substantially prevents the first ram member 14, or at least shell member 42, from sliding completely out of the hollow tube 12. Furthermore, projection portion 98 may extend beyond the outer surface 22 of the tubular wall 18.

Figure 12B:
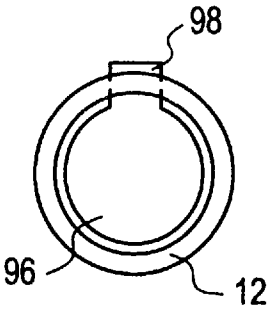
FIG. 12A is a partial side elevational cutaway view and FIG. 12B is an end view of an embodiment of a first ram member having a collar member disposed on the outwardly facing end, and a pin which may limit the insertion of the support rod into the shell member, and which may also limit the insertion of the support member into the tube.
Figure 12A:
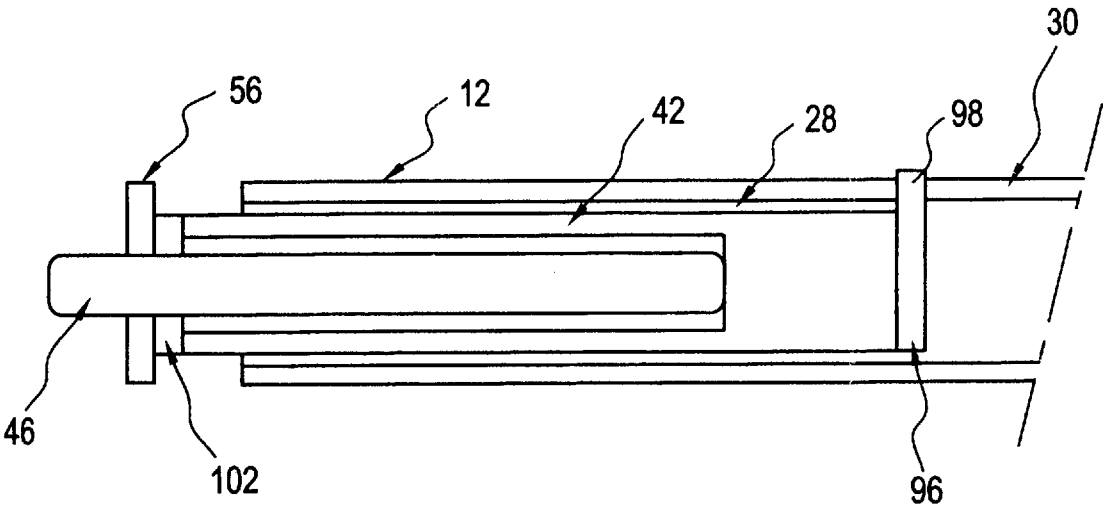

As seen in FIGS. 2, 3, and 12 the spreading tool 10 may include a means 100 for limiting the entry of the support rod 46 into the axial bore 44 of the shell member 42. A collar member 102 is attached to the outwardly facing open end 50 of the shell member 42 and has a central bore 104 adapted to allow the support rod 46 to slide therethrough. In the embodiment shown in FIG. 2, at least a portion of the collar 102 also abuts the first end 24 of the hollow tube 12. The collar member 102 may be threadedly attached to the support rod 46 or attached to the support rod 46 by threaded fasteners. The collar member 102 may also be fixedly attached to the support rod 46.

Pin 56 preferably abuts the collar member 102, as illustrated in the embodiment of FIG. 12, particularly if the pin 56 has not been adapted to abut the first end 24 of the hollow tube 12.

Figure 13:
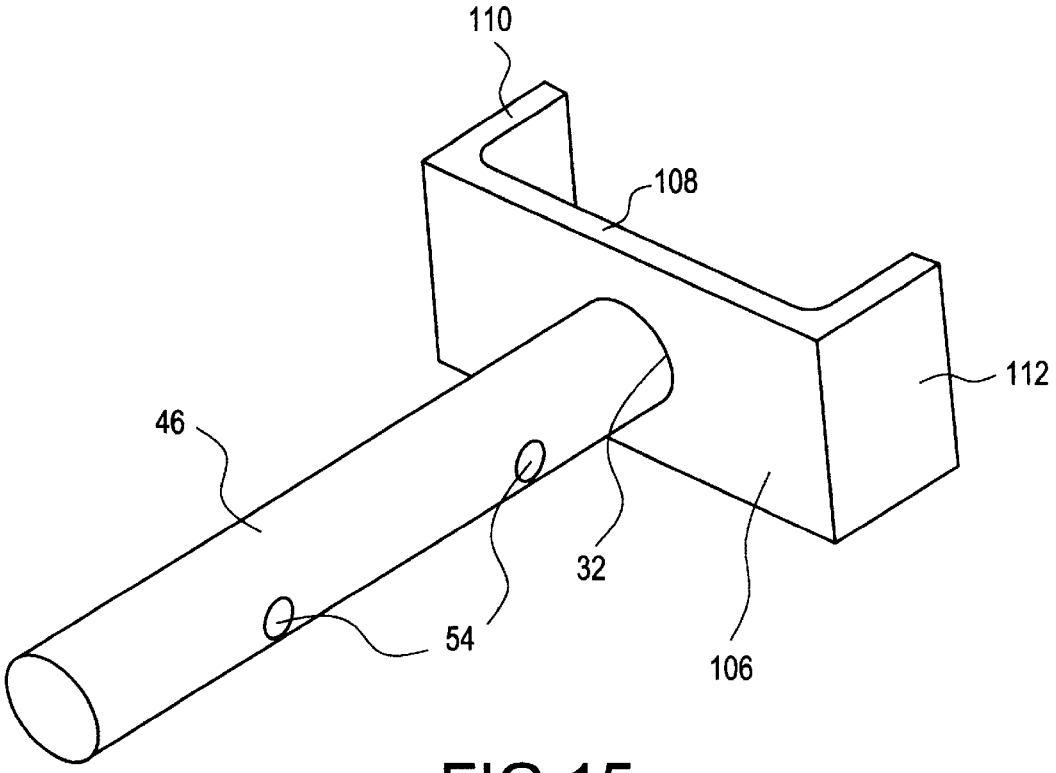
FIG. 13 is a perspective view of an embodiment of a support rod and a bracket member having arm portions disposed at substantially right angles to a base portion.

A bracket member 106 is shown in FIGS. 2, 3 and 13 attached to the outwardly facing end 32 of the first ram member 14. The bracket member 106 provides a grasping support means which enables the tool to be wedged or propped against an object. The object, or a portion thereof, will be cradled by the bracket member 32. It may be desirable to move or deform the object with the tool 10, or to allow the object to serve as a base or anchoring point. The bracket member 106 preferably includes a base portion 108 and two opposite arm portions 110, 112. The arm portions 110, 112 shown on the bracket member 106 of FIG. 13 are each disposed at substantially right angles from the base portion 108. The arm portions 110, 112 shown on the bracket member 106 of FIGS. 2 and 3 are disposed at obtuse angles from the base portion 108. Preferably, the bracket member 106 is attached to the support rod 46 by a threaded fastener 114.

Thus, the bracket member 106 provides a force distribution means or a cradling means attached to a distal end of the first piston member 14.

The alternate embodiment of the base plate 66 shown in FIG. 9 has an opening 116 adapted to fit over protrusion 118 disposed on the substantially flat portion of the outwardly facing end 36 of the second ram member 16. Thus, the base plate 66 can be removably mounted to the second ram member 16. Alternatively, the outwardly facing end 36 of the second ram member 16 may be threaded, and the base plate 66 may have a threaded opening for receiving the second ram member 16. Furthermore, the base plate 66 and second ram member 16 may be releasably attached by threaded fasteners. Thus, the base plate 66 may be placed or secured in relationship to the second ram member 16 before, or during, positioning of the tool 10 in use.

Figure 4:
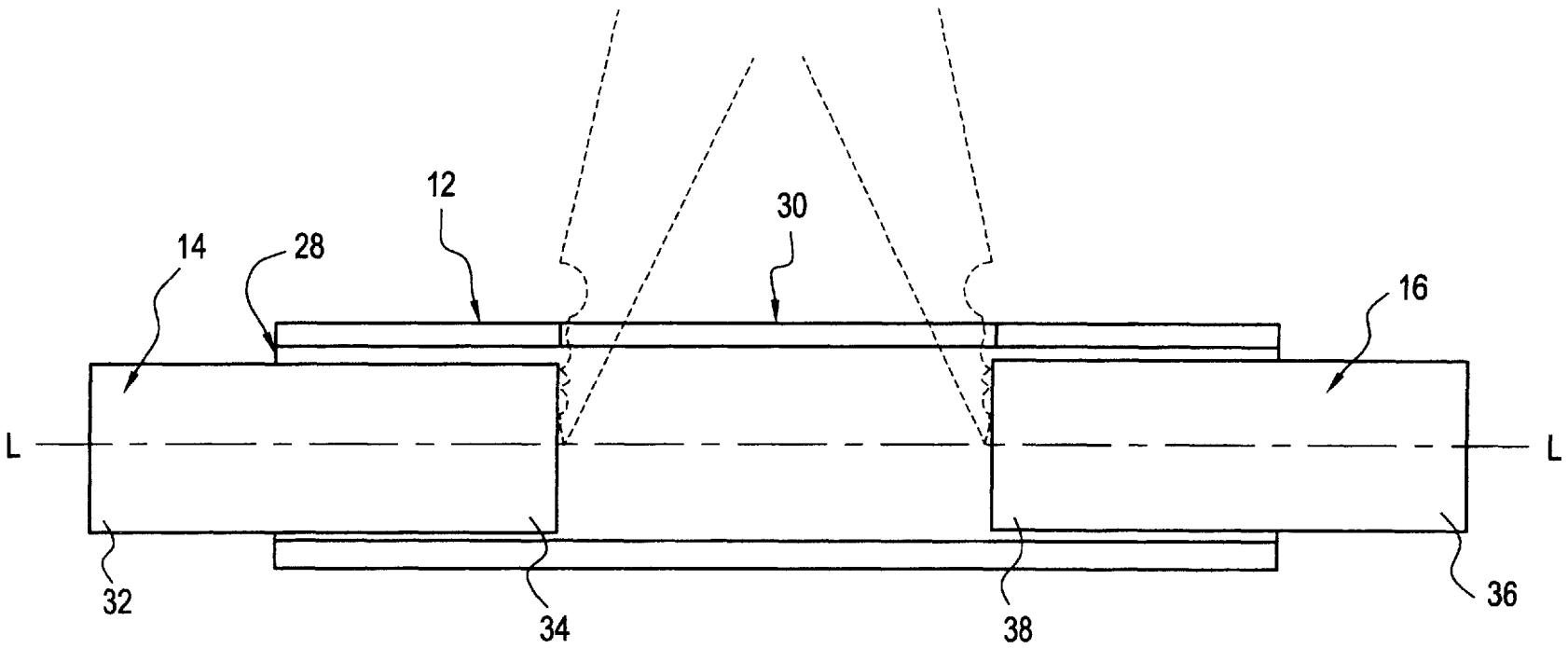
FIG. 4 is a side elevational cutaway view of another embodiment comprising a hollow tube with an opening, and first and second ram members extending partially out of the tube, and showing the spreadable tips of a prior art force multiplying device in phantom.
Figure 5:
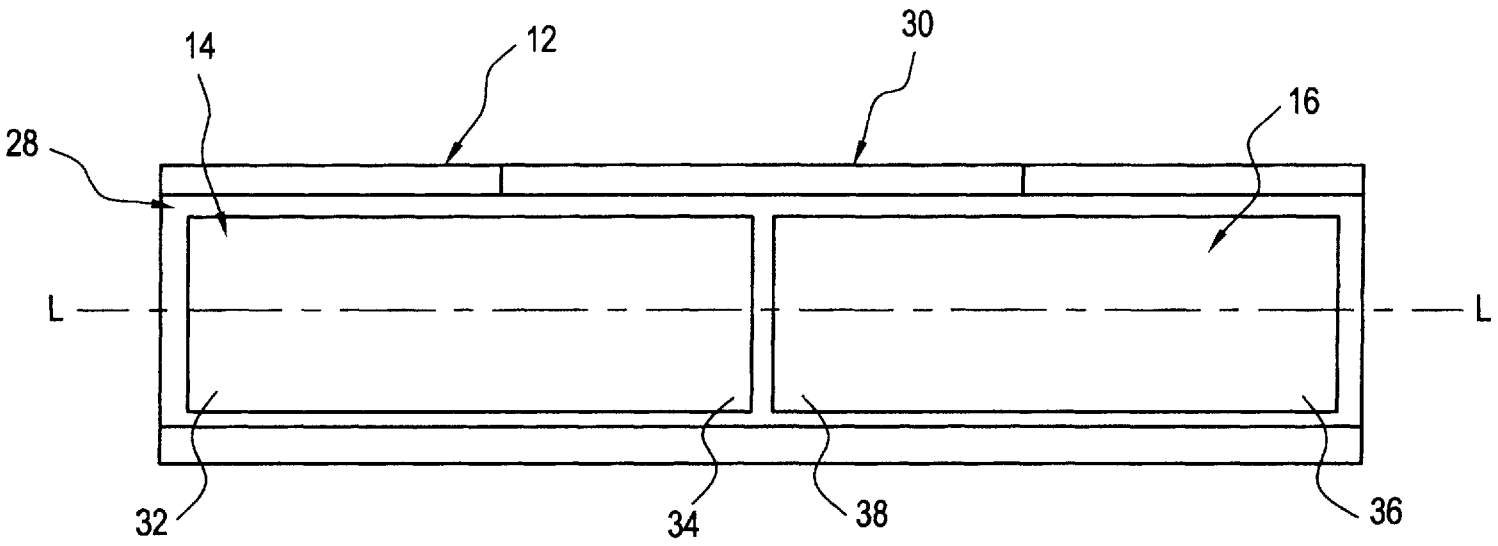
FIG. 5 is a side elevational cutaway view of the embodiment of FIG. 3 showing the first and second ram members residing entirely within the tube.

FIGS. 4 and 5 show first and second ram members 14 and 16 that includes neither a shell member 42, an outwardly facing axial bore 44, nor a support rod 46. Each ram member 14, 16 is slidably moveable within the hollow tube 12. FIG. 4 shows the ram members 14, 16 in an extended or actuated position. FIG. 5 shows the ram members 14, 16 in the retracted position.

Figure 14B:
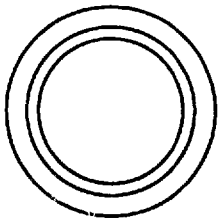
FIG. 14B is an end view of a hollow tube having holes at opposite ends for fixing a second member at either end.
Figure 14A:
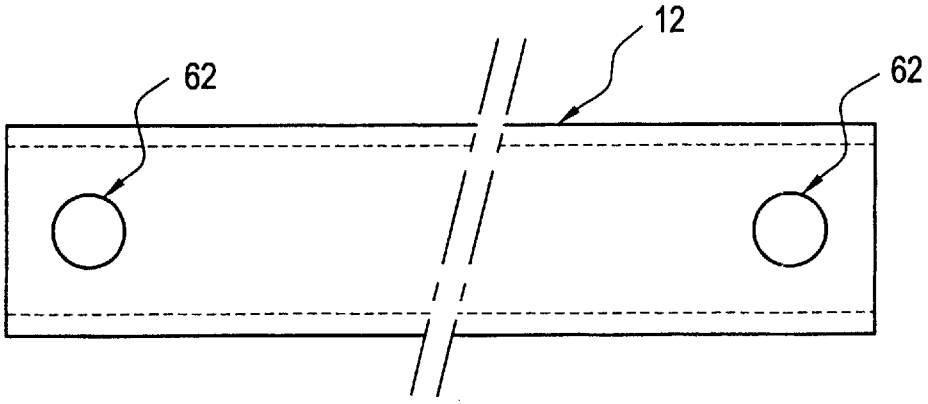
FIG. 14A is a side elevational view.

As seen in FIG. 14, the hollow tube 12 may be modified to accommodate interchanging between the first and second ram members 14 and 16. Holes 62 appear on both ends of the tube 12. Furthermore, instead of having first and second ram members 14 and 16 as described above, the tool 10 may comprise two first ram members 14, or two second ram members 16. Thus, one or both first ram members 14 may be telescoping; one or both first ram members 14 may have bracket members 106; and one or both second ram members 16 may have pointed or conical tip portions 68.

Furthermore, gripping means 74 may be disposed on a distal end of the first or second piston member, 14 or 16, or both, for reducing slippage of the tool 10 during use.

Figure 15:
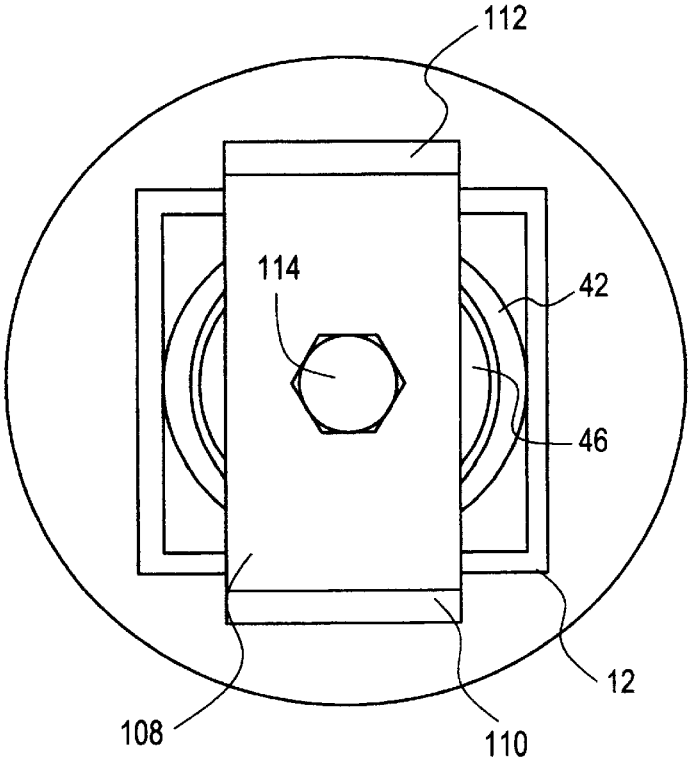
FIG. 15 is an end view of an embodiment of the present invention having a generally square cross-sectional hollow tube member.

The hollow tube 12 may have a generally circular cross-section, as shown in FIG. 2, or some other cross-sectional shape, such as the square cross-section shown in FIG. 15.

In one particular embodiment, the hollow tube 12 is an extruded tube having a 3 inch outer diameter and a 0.375 inch tubular wall made from 6061-T651 aluminum. Shell member 42 has a minimum outside diameter of 1.875 (+0, −0.104) and a maximum outside diameter of 2.25 inches and is made from 2024-T351 aluminum. These members may be made of aluminum, for example, in order to reduce the overall weight of the tool 10. The second ram member 16, the support rod 46, the base plate 66, the bracket member 106, and the threaded fastener 114 are made from 4330/4340 heat treated steel. The gripping means 74, interior end plate 96 and collar member 102 are constructed from steel. The longitudinally spaced transverse holes 54 in support rod 46 are preferably ½ inch holes bored entirely through the support rod 46, and pin or bolt 56 is correspondingly sized to fit within the holes 54. Transverse hole 56 has a diameter of ⅜ inch, and pin or bolt 60 is correspondingly sized to fit within the hole 56. It should be understood that the above embodiment, as well as other embodiments, may include different sizes, dimensions, and/or materials.

One or more elements of the tool 10 may be lubricated, especially those elements which frictionally contact other elements, such as during sliding or rotating engagement. Lubrication may include oil, grease, graphite, or other liquid or solidbased lubricants, including mixtures of solid and liquid lubricants.

In operation, the tool 10 is positioned between two contact points or contact surfaces by gripping the handle means 82 and inserting the tool in the desired location. The first and second ram members 14, 16 are moved apart through opening 30, either by hand, by some tool such as a crowbar, or by the tips of a force multiplying device, to provide a minimum offset between the ram members in order to receive the tips of a force multiplying device through opening 30. The tips are inserted and caused to spread apart, thereby moving or prying apart the first and second ram members 14, 16.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A tool for use with a force multiplying device having at least two spreadable tips which transmits an output force through a relative displacement between the spreadable tips, the tool comprising:

a hollow tube comprising a tubular wall having an outer surface and an inner surface which defines a longitudinal inner cavity, said tubular wall being provided with opening extending therethrough to the longitudinal inner cavity, the opening being adapted to receive the spreadable tips and to allow the relative displacement therebetween;

a first extension member disposed in the longitudinal inner cavity of said tube; and a second extension member disposed in the longitudinal inner cavity of said tube, wherein said first and second extension members are capable of being moved apart;

wherein the opening in said hollow tube is adapted to allow the spreadable tips to contact said first and second extension members; and wherein an increase in the relative displacement between the spreadable tips induces an increase in a relative displacement between said first and second extension members;

whereby the output force is transmitted from the spreadable tips through said extension members; and whereby said tool is capable of amplifying the relative displacement over which the output force is transmitted.

2. The tool according to claim 1 wherein said first extension member is slidingly disposed in said tube.

3. The tool according to claim 1 wherein said second extension member is slidingly disposed in said tube.

4. The tool according to claim 1 further comprising means for preventing rotation of said first extension member.

5. The tool according to claim 1 further comprising means for preventing rotation of said second extension member.

6. The tool according to claim 1 further comprising means for selectively fixing said second extension member within said tube.

7. The tool according to claim 1 further comprising handle means disposed on an outer surface of said tube.

8. The tool according to claim 1 wherein said first extension member further comprises a telescoping extension member.

9. The tool according to claim 1 further comprising means for limiting the insertion of said first extension member into said tube.

10. The tool according to claim 1 further comprising means for distributing the force transmitted through said first extension member.

11. The tool according to claim 1 further comprising bracket means attached to the distal end of said first extension member.

12. The tool according to claim 1 further comprising means for distributing the force transmitted through said second extension member.

13. The tool according to claim 1 further comprising a base plate attached to a distal end of said second extension member.

14. The tool according to claim 1 further comprising a base ring removably attached to a distal end of said second extension member.

15. The tool according to claim 14 wherein said second extension member further comprises a pointed distal end.

16. The tool according to claim 1 further comprising gripping means disposed on a distal end of said first or second extension members for reducing slippage of said tool during use.

17. A spreading tool comprising:

a hollow tube having:

a tubular wall with inner and outer surfaces;

first and second ends;

an axial throughbore defined by the inner surface of said tubular wall and extending from the first end to the second end along a longitudinal axis; and at least one opening extending through said tubular wall;

a first ram member slidingly disposed within said throughbore and having an outwardly facing end and an inwardly facing end, wherein the outwardly facing end is capable of extending beyond the first end of the hollow tube; and a second ram member slidingly disposed within said throughbore and having an outwardly facing end and an inwardly facing end, wherein the outwardly facing end is capable of extending beyond the second end of the hollow tube;

wherein the inwardly facing ends of said first and second ram members are capable of being spaced apart between a minimum offset and a second offset in an activation portion of said hollow tube;

wherein at least a portion of said opening is disposed over the activation portion of said hollow tube; and wherein one or both of said ram members are capable of projecting at least partially out of said hollow tube when said ram members are separated by the second offset.

18. The spreading tool according to claim 17 wherein said first ram member further comprises:

a shell member slidingly disposed within said throughbore and having an inwardly facing closed end and an outwardly facing open end;

an outwardly facing axial bore extending partially into said shell member; and a support rod inserted into said axial bore.

19. The spreading tool according to claim 18 wherein said support rod is slidingly disposed in said axial bore.

20. The spreading tool according to claim 18 further comprising a means for selectively limiting the insertion of said support rod into said hollow tube.

21. The spreading tool according to claim 20 further comprising one or more longitudinally spaced transverse holes disposed in said support rod and at least one pin for insertion into one of said holes.

22. The spreading tool according to claim 21 wherein said pin is capable of abutting the first end of said hollow tube.

23. The spreading tool according to claim 21 wherein said base plate is removably attached to said second ram member.

24. The spreading tool according to claim 21 further comprising a collar member attached to the outwardly facing open end of said shell member and having a central bore adapted to allow said support rod to slide therethrough, wherein said pin is capable of abutting said collar member.

25. The spreading tool according to claim 18 wherein said support rod further comprises a telescoping support rod.

26. The spreading tool according to claim 18 wherein the inwardly facing end of said first ram member further comprises an interior end plate wherein said end plate includes a projection portion adapted to extend at least partially through said opening and to abut a portion of the tubular wall surrounding the opening, whereby any contact between said projection portion and said hollow tube substantially prevents said first ram from rotating.

27. The spreading tool according to claim 18 further comprising a means for limiting the entry of said shell member into the throughbore of said hollow tube.

28. The spreading tool according to claim 27 wherein said entry limiting means further comprises a collar member attached to the outwardly facing open end of said shell member and having a central bore adapted to allow said support rod to slide therethrough, wherein at least a portion of said collar is capable of abutting the first end of said hollow tube.

29. The spreading tool according to claim 28 wherein said collar member is threadedly attached to said shell member.

30. The spreading tool according to claim 29 wherein said collar member is attached to said shell member by threaded fasteners.

31. The spreading tool according to claim 28 wherein said collar member is fixedly attached to said shell member.

32. The spreading tool according to claim 17 wherein said second ram member further comprises means for selectively fixing said second ram member within said throughbore.

33. The spreading tool according to claim 32 wherein said means for selectively fixing said second ram member further comprises:

one or more transverse holes disposed in said second ram member;

one or more transverse holes disposed through said hollow tube; and at least one adjustment pin for insertion into one of said holes in said tube and one of said holes in said second ram member.

34. The spreading tool according to claim 33 further comprising means for selectively fixing said second ram member in more than one fixed position, with a series of longitudinally spaced holes.

35. The spreading tool according to claim 17 further comprising a base plate adapted to engage the outwardly facing end of said second ram member.

36. The spreading tool according to claim 35 wherein said base plate further comprises a gripping means disposed on an outwardly facing surface of said base plate.

37. The spreading tool according to claim 36 wherein said gripping means further comprises at least one projection extending from the outwardly facing surface of said base plate.

38. The spreading tool according to claim 35 wherein said base plate is threadedly attached to said second ram member.

39. The spreading tool according to claim 17 wherein the outwardly facing end of said second ram member further comprises a substantially conical tip portion.

40. The spreading tool according to claim 39 wherein said base plate further comprises a base ring having an internal bore adapted to slide onto and engage the conical tip portion.

41. The spreading tool according to claim 40 wherein said base ring further comprises a gripping means disposed on an outwardly facing surface of said base ring.

42. The spreading tool according to claim 41 wherein said gripping means further comprises at least one projection extending from the outwardly facing surface of said base plate.

43. The spreading tool according to claim 17 wherein the outwardly facing end of said second ram member further comprises a substantially flat portion.

44. The spreading tool according to claim 17 further comprising a handle means disposed on the outer surface of the tubular wall.

45. The spreading tool according to claim 17 further comprising a means for preventing rotation of said first and second ram members.

46. The spreading tool according to claim 45 wherein said rotation prevention means further comprises:

a slot means disposed on the inner surface of said tubular wall; and a first engagement means disposed on the outer surface of said first ram member and adapted to slidingly engage said slot means for allowing said ram member to slide axially within the throughbore of said hollow tube and for substantially preventing rotation of said ram member; and a second engagement means disposed on the outer surface of said second ram member and adapted to slidingly engage said slot means for allowing said ram member to slide axially within the throughbore of said hollow tube and for substantially preventing rotation of said ram member.

47. The spreading tool according to claim 17 further comprising a bracket member attached to the outwardly facing end of said first ram member.

48. The spreading tool according to claim 47 wherein said bracket member further comprises a base portion and two opposite arm portions.

49. The spreading tool according to claim 48 wherein arm portions are disposed at substantially right angles from said base portion.

50. The spreading tool according to claim 48 wherein arm portions are disposed at obtuse angles from said base portion.

51. A spreading tool for use with a portable rescue device having at least two expandable jaws, the tool comprising:

a first elongate piston member;

a second elongate piston member; and a hollow tube comprising a tubular wall having outer surface and an inner surface which defines a longitudinal inner cavity, said tubular wall being provided with an opening extending therethrough to the longitudinal inner cavity, the opening being adapted to receive the expandable jaws and to allow a relative displacement therebetween, wherein said hollow tube is adapted to hold said first and second piston members in spaced apart end-to-end relationship in the longitudinal inner cavity, wherein said first and second piston members are capable of being moved apart by the expandable jaws extending through the opening into the longitudinal inner cavity;

whereby said tool is capable of extending the expandable distance of the jaws.

52. The tool according to claim 51 wherein said first piston member is slidingly disposed in said tube.

53. The tool according to claim 52 wherein said second piston member is fixedly disposed in said tube.

54. The tool according to claim 51 wherein said second piston member is slidingly disposed in said tube.

55. The tool according to claim 54 further comprising means for selectively fixing said second piston member within said tube.

56. The tool according to claim 51 further comprising means for preventing rotation of said first piston member.

57. The tool according to claim 51 further comprising means for preventing the rotation of said second piston member.

58. The tool according to claim 51 further comprising means for selectively fixing said second piston member within said tube.

59. The tool according to claim 51 further comprising handle means disposed on an outer surface of said tube.

60. The tool according to claim 51 wherein said first piston member further comprises a telescoping piston member.

61. The tool according to claim 51 further comprising means for limiting the insertion of said first piston member into said tube.

62. The tool according to claim 51 further comprising a force distribution means attached to a distal end of said first piston member.

63. The tool according to claim 51 further comprising bracket means attached to a distal end of said first piston member.

64. The tool according to claim 51 further comprising a force distribution means attached to a distal end of said second piston member.

65. The tool according to claim 51 further comprising a base plate attached to a distal end of said second piston member.

66. The tool according to claim 51 further comprising a base ring removably attached to a distal end of said second piston member.

67. The tool according to claim 66 wherein said second piston member further comprises a pointed distal end.

68. The tool according to claim 51 further comprising gripping means disposed on a distal end of said first or second piston member for reducing slippage of said tool during use.

* * * * *